US006290251B1

(12) United States Patent
Chatillon et al.

(10) Patent No.: US 6,290,251 B1
(45) Date of Patent: Sep. 18, 2001

(54) SKI BINDING WITH LATERAL BREAKAWAY ACTION

(75) Inventors: Christophe Chatillon, Decize; Christian Lucas, Nevers; Michel Thevenet, Coulanges les Nevers, all of (FR)

(73) Assignee: Look Fixations SA, Nevers (FR)

( * ) Notice: Subject to any disclaimer, the term of this patent is extended or adjusted under 35 U.S.C. 154(b) by 139 days.

(21) Appl. No.: 08/971,611

(22) Filed: Nov. 17, 1997

(30) Foreign Application Priority Data

Nov. 18, 1996 (FR) ..... 96 14339

(51) Int. Cl.[7] ..... A63C 9/00
(52) U.S. Cl. ..... 280/636; 280/629
(58) Field of Search ..... 280/636, 611, 280/623, 626, 628, 629, 630, 634

(56) References Cited

U.S. PATENT DOCUMENTS

| | | | | |
|---|---|---|---|---|
| Re. 33,388 | * | 10/1990 | Sedlmair et al. | 280/625 |
| 4,398,747 | * | 8/1983 | Bernard et al. | 280/630 |
| 4,911,464 | * | 3/1990 | Gallet et al. | 280/636 |
| 4,928,990 | * | 5/1990 | Rullier | 280/625 |
| 5,114,174 | * | 5/1992 | Bogner | 280/636 |
| 5,921,573 | * | 7/1999 | Challande et al. | 280/636 |

FOREIGN PATENT DOCUMENTS

| | | |
|---|---|---|
| 477 890 | 10/1969 | (CH) . |
| 447 779 | 2/1991 | (EP) . |
| 729 771 | 9/1996 | (EP) . |
| 2125782 | 9/1972 | (FR) . |
| 2652508 | 4/1991 | (FR) . |

* cited by examiner

*Primary Examiner*—J. J. Swann
*Assistant Examiner*—David R. Dunn
(74) *Attorney, Agent, or Firm*—Fay, Sharpe, Fagan, Minnich & McKee, LLP

(57) ABSTRACT

A rear binding (6) releasably clamps a heel (5) of a boot (1) to a ski (2). A front binding (4) which engages a toe (3) of the boot releases under lateral force towards the left or right side of the ski. A support assembly (8) engages a sole (7) of the ski boot to reduce frictional forces between the ski boot and ski which might impair the release of the front binding. The support device includes a stationary support (9) which is mounted to the ski and which defines a lateral groove (13) having a generally inverted T-shaped cross section. A movable element (10) which is slidably received in the groove has an upper surface that supports the boot sole. A friction reducing element (20), such as a layer of low coefficient of friction plastic is disposed between the movable element and the stationary support such that the movable element and the toe of the boot can move laterally with minimum frictional resistance.

17 Claims, 14 Drawing Sheets

201a
104a
102a 133a
133
103
10
11

12
102r
104r
133r
201r 103
133
201a
104a 133a
133
103
100
10
8
90
12
11

104r
201r
133r 103
133
9
133a
201a
104a 133
103
10
12
11

201r
104r
133r 103
133

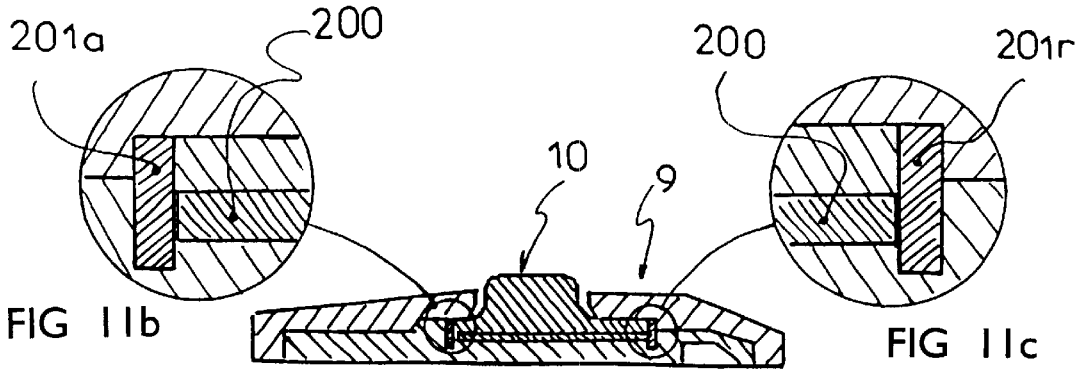
FIG 11b
FIG 11c
FIG 11a
FIG 12a
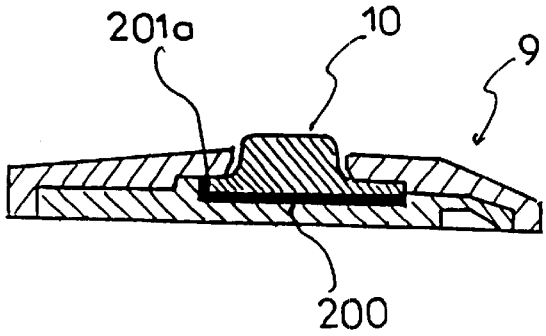
FIG 13a
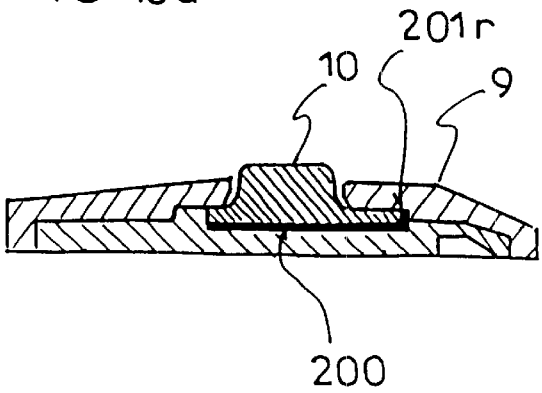

SKI BINDING WITH LATERAL BREAKAWAY ACTION

BACKGROUND OF THE INVENTION

The present invention relates to bindings for winter sports equipment. It finds particular application in conjunction with ski bindings and will be described with particular reference thereto.

Typically, the boot of a skier is disengagably retained on the ski. Commonly, the front end of the boot is mounted in a front fixation or stop. The rear end of the boot is releasably retained in a rear fixation or trailing end.

In the event of a significant force which places the leg or joints of the skier at risk, the ski boot releases at either the front end or the rear end of the boot, or at both ends simultaneously. To this end, the front stop may comprise a jaw which pivots around a vertical axis and the trailing end a jaw pivoting in an upward direction around a horizontal axis. The front and trailing edge jaws are each acted upon by a disengagement spring whose compression is adjustable to adjust the force at which the ski boot releases.

Support devices have, heretofore, been positioned beneath the front of the boot in order to limit the friction of the bottom surface of the front end of the sole on the ski. Such support devices are fixed or connected to the ski adjacent the front of the boot between the boot sole and the upper surface of the ski. In this manner, the front portion of the sole does not rest directly on the ski, but on the support device. The support device, for example, may be a small plate of a low friction coefficient material such as polytetrafluoroethylene (TEFLON™). The plate may be a fixed element or a movable element which laterally tracks the end of the boot at the moment of its lateral displacement. See, for example, published French Patent Application No. 2,652,508. Such devices provide improved skier safety. One drawback of such devices is that the displacement of a movable plate may be counteracted in an uneven or uncontrolled manner.

The present application overcomes the above-referenced drawbacks.

SUMMARY OF THE INVENTION

In accordance with one aspect of the present invention, a support device for supporting a ski boot on a ski includes a movable support element which is movable relative to a stationary support. The movable support is movable at least in a transverse direction. At least one anti-friction element lies between the movable and stationary supports.

In accordance with a more limited aspect of the present invention, the anti-friction element is made of a material with a lower coefficient of friction than the material of which the movable and stationary supports are made.

In accordance with a yet more limited aspect of the present invention, the low coefficient material is one of polytetrafluoroethylene or high-density polyethylene; the stationary support is made of polypropylene or polyamide and the movable support element is made of a plastic material such as acetyl resin or a metal compound.

In accordance with a more limited aspect of the present invention, the anti-friction element has a lower horizontal anti-friction plate and at least one front anti-friction plate. Optionally, a rear anti-friction plate can be provided as well.

In accordance with one of the specific embodiments, the front and/or rear anti-friction plates are integral with the lower anti-friction plate. In another specific embodiment, one or both of the front and rear anti-friction plates is independent of the lower anti-friction plate.

In accordance with a yet more limited embodiment of the present invention, the movable support element moves transversely in a curved groove.

One advantage of the present invention is that it provides improved lateral displacement of the movable support element.

Another advantage of the present invention is that it provides constant frictional resistance to movement of the movable support element.

Another advantage of the present invention resides in the reliable disengagement of the binding regardless of the force applied by the boot. It releases in response to force towards the front or toward the rear.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

FIG. 11*a* is a longitudinal sectional view through the assembled device of FIG. 11 and FIGS. 11*b* and 11*c* are detailed views illustrating interaction points between the movable and stationary support elements;

FIG. 12*a* is a longitudinal sectional view through the assembled device of FIG. 12;

FIG. 13*a* is a longitudinal sectional view through the assembled device of FIG. 13;

DETAILED DESCRIPTION OF THE PREFERRED EMBODIMENTS

Figure 1:
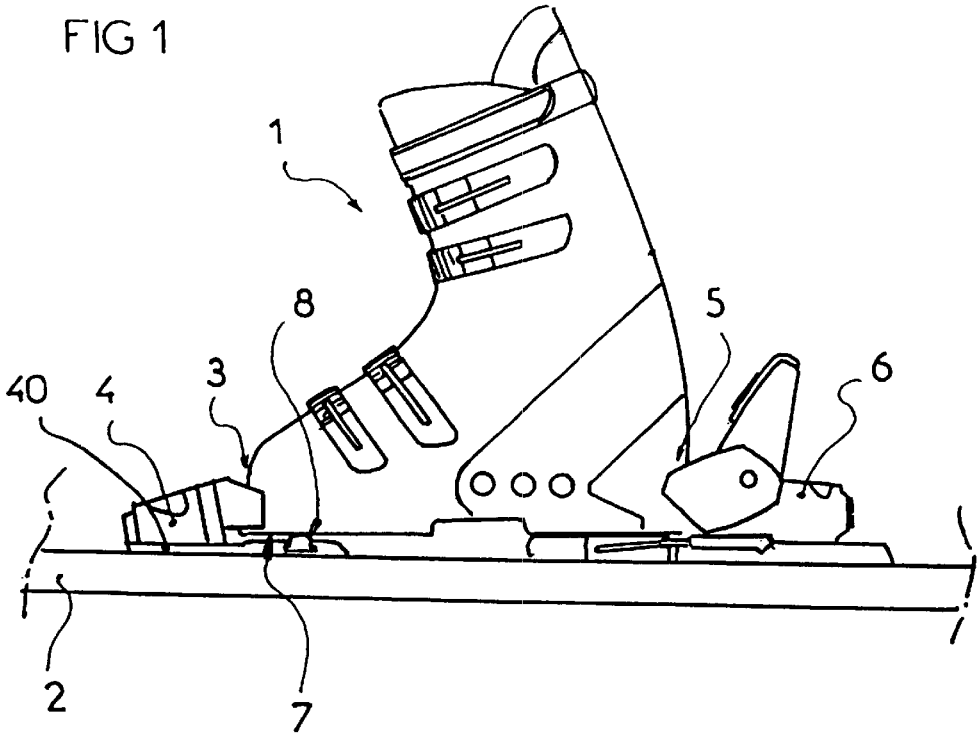
FIG. 1 is a side elevational view of a ski, ski boot, and binding in accordance with the present inventions.
Figure 2:
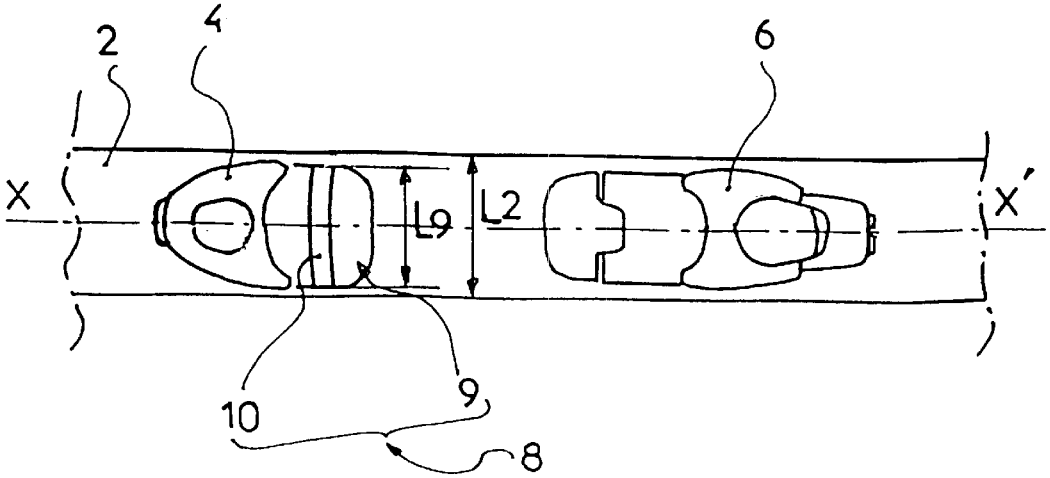
FIG. 2 is a top view of the ski and binding of FIG. 1 with the boot removed.
Figure 3A:
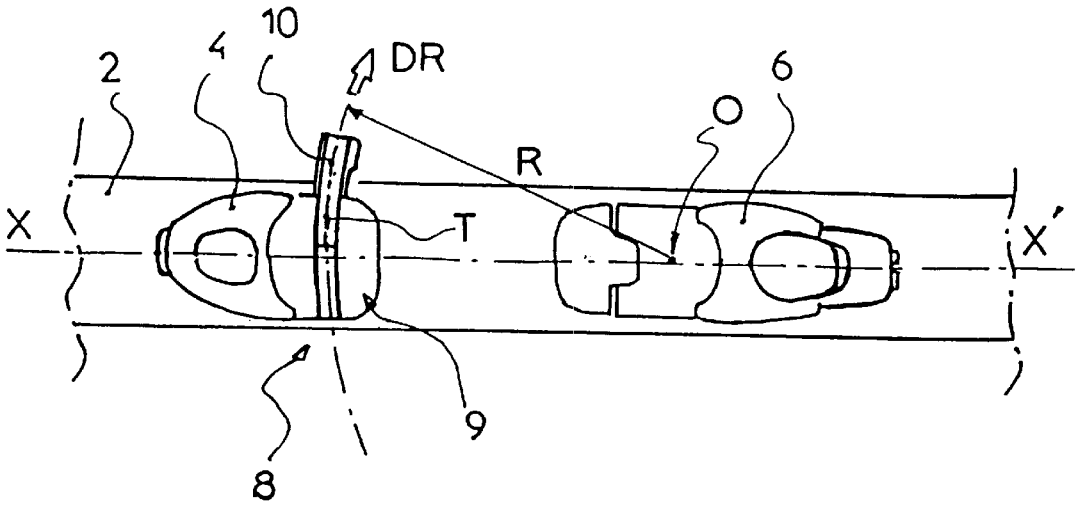
FIGS. 3*a* and 3*b* are top views similar to FIG. 2 depicting, respectively, displacement of the movable support element to the right and to the left.
Figure 3B:
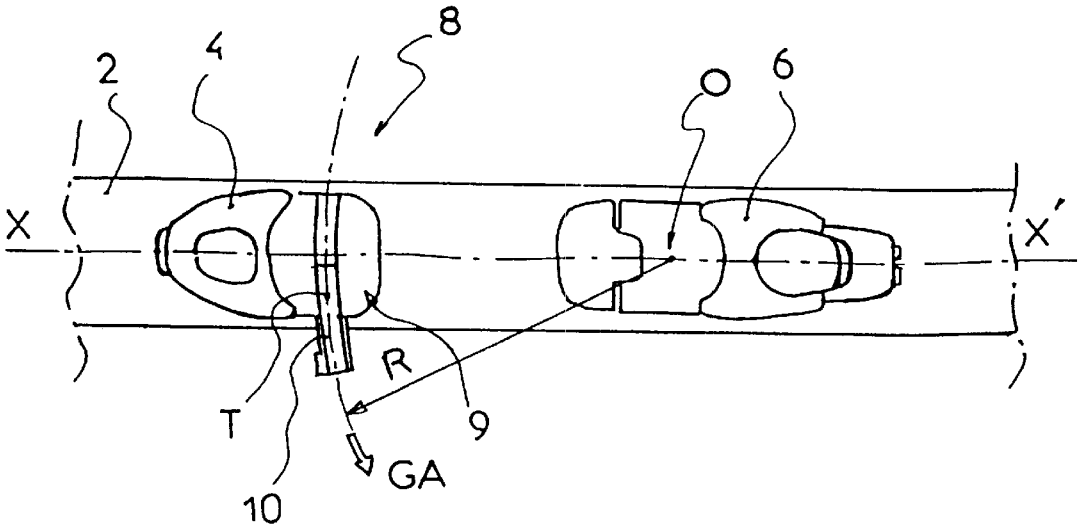
Figure 4:
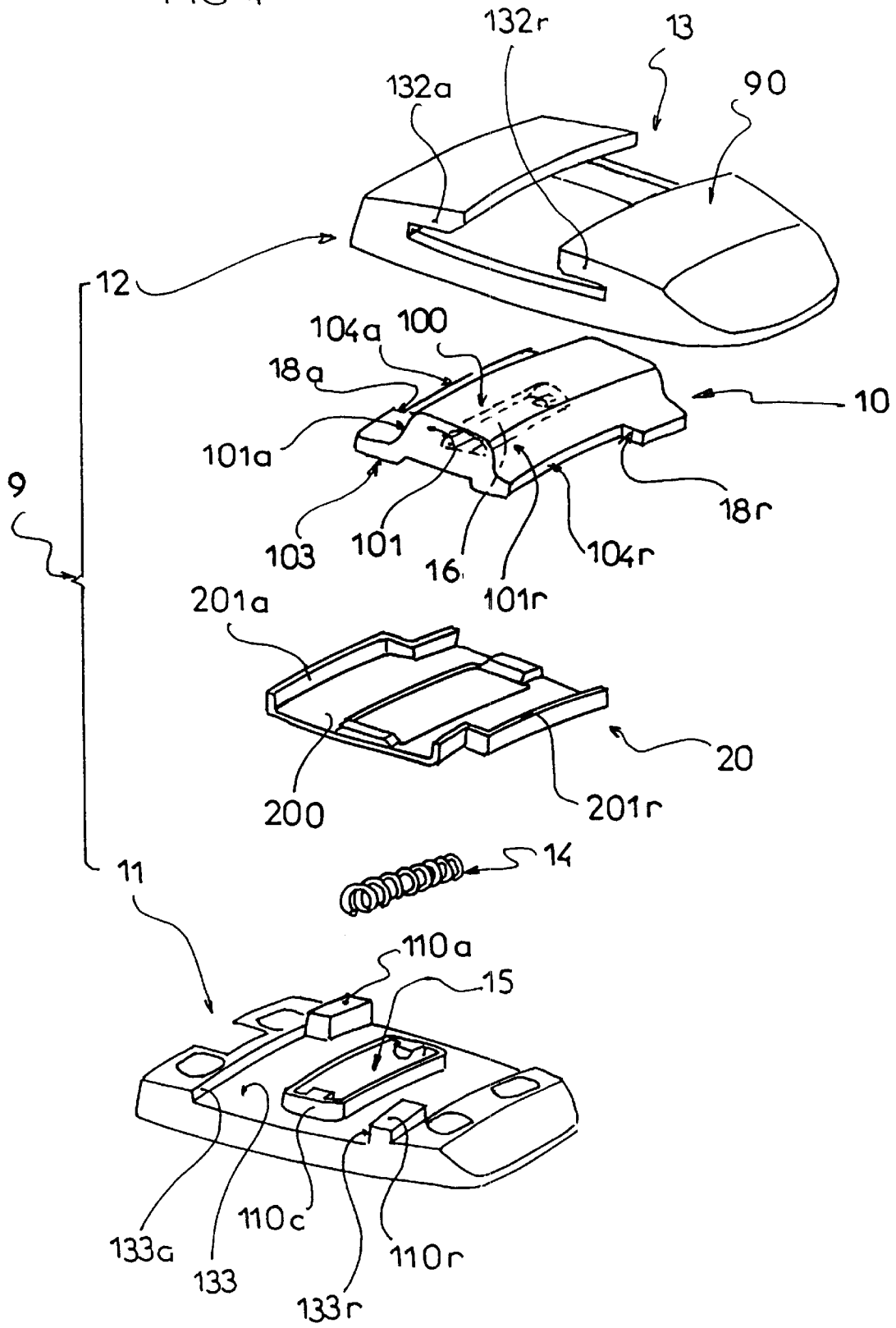
FIG. 4 is an exploded, perspective view of a first embodiment of a support device in accordance with the present invention.
Figure 5:
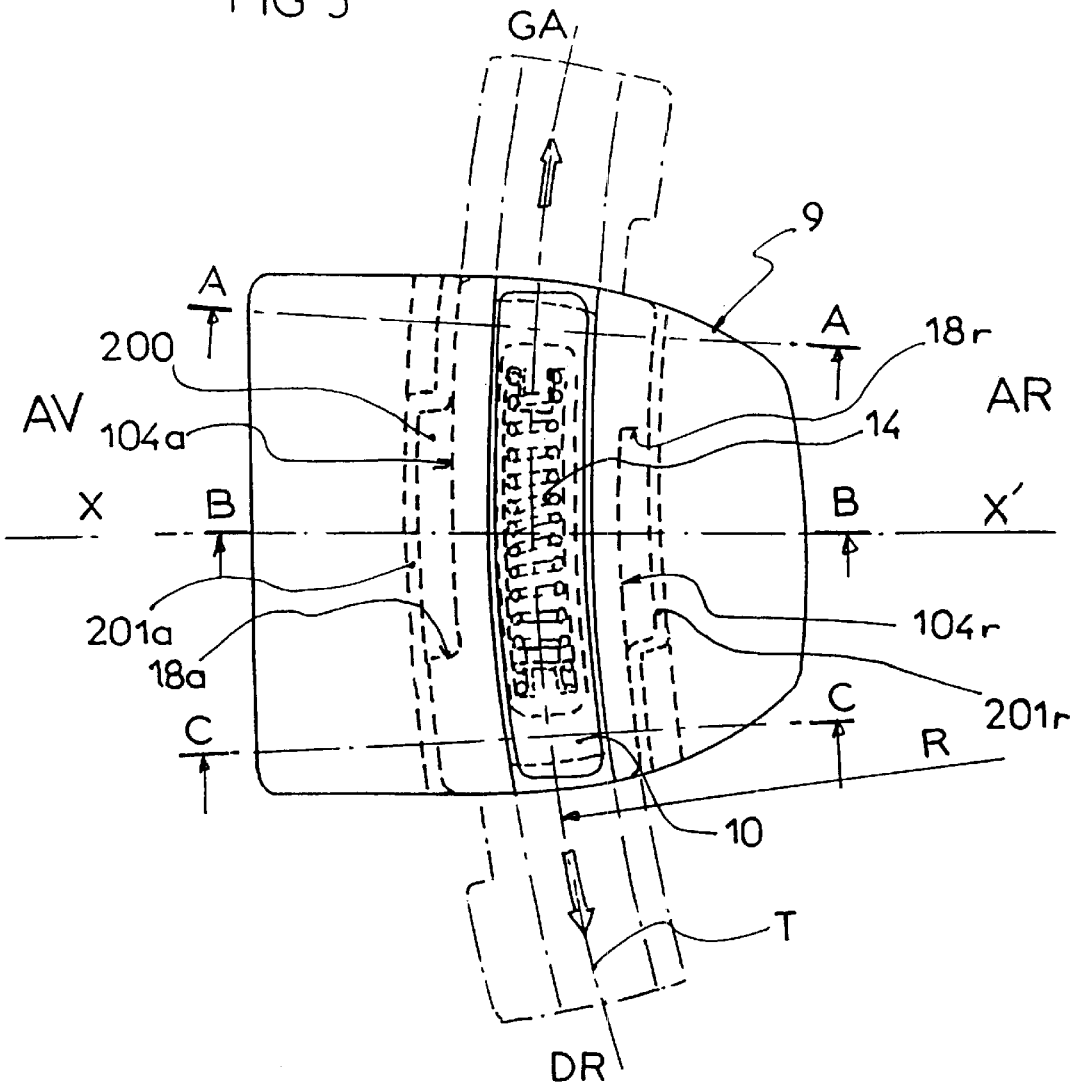
FIG. 5 is a top view of the assembled device of FIG. 4 with the movable element illustrated in phantom in two laterally displaced positions.
Figures 6A, 6B, 6C, 6D, 6E, 6F, 6G, 6H, 6I:
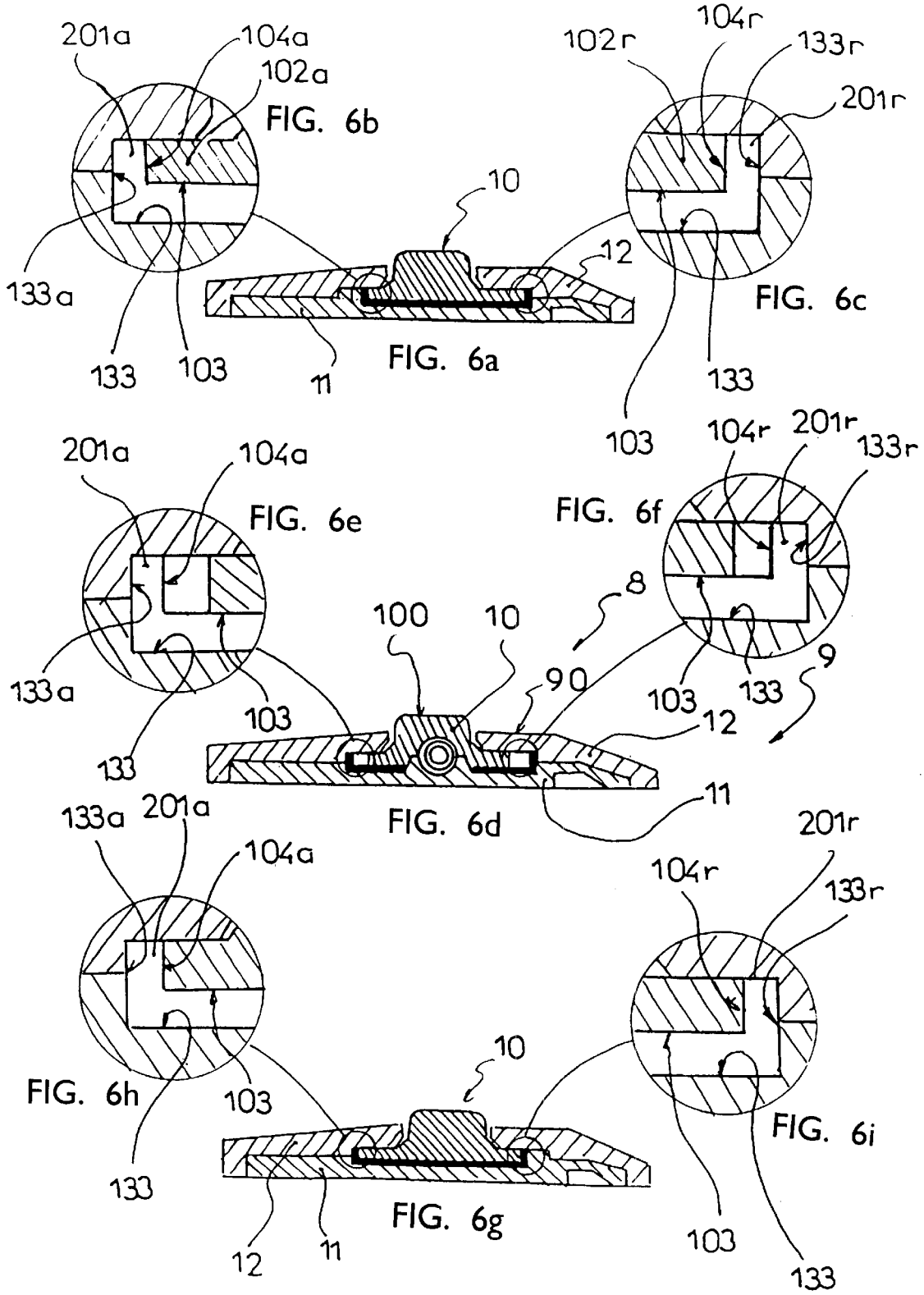
FIG. 6*a* is a sectional view through Section A—A of FIG. 5 and FIGS. 6*b* and 6*c* represent enlargements of the interaction point between the movable and stationary support elements.
FIG. 6*d* is a cross-sectional view though Section B—B of FIG. 5 and FIGS. 6*e* and 6*f* represent enlargements of the interaction point between the movable and stationary support elements.
FIG. 6*g* is a cross-sectional view though Section C—C of FIG. 5 and FIGS. 6*h* and 6*i* represent enlargements of the interaction point between the movable and stationary support elements.
Figure 7:
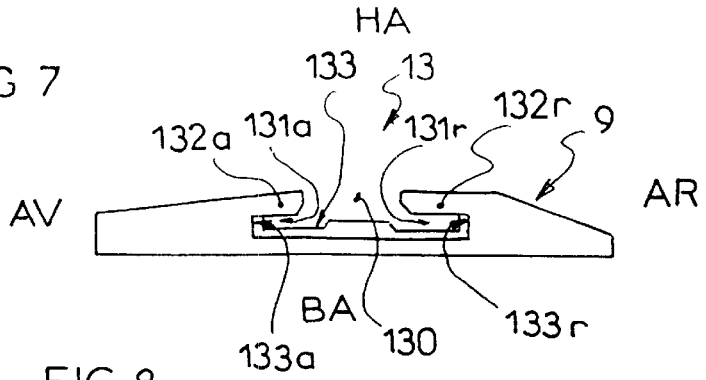
FIG. 7 is an exterior side view of the stationary support without the mobile element and spring.
Figure 8:
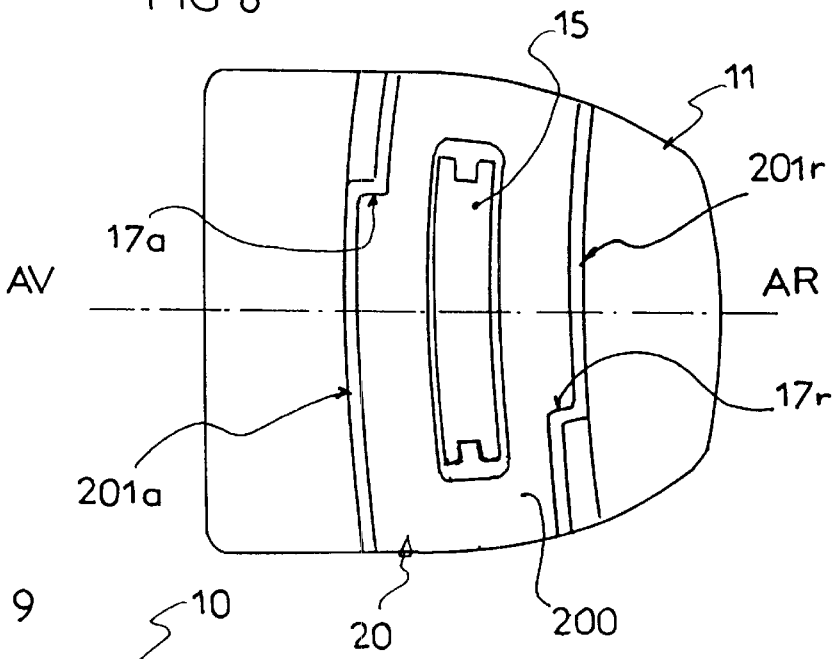
FIG. 8 is a top view of the stationary support element of FIG. 7.
Figure 9:
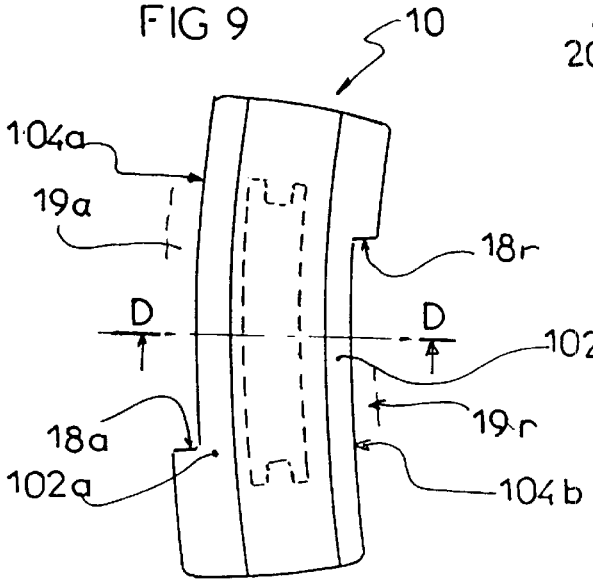
FIG. 9 is a top view of a mobile element for receipt in the stationary element of FIGS. 7 and 8.

With reference to FIGS. 1 and 2, a skier's boot 1 is retained on a ski 2 in a disengageable or releasable fashion at a front end by a front safety binding assembly or stop 4. The boot is disengageably retained at its heel 5 by a safety rear or heel binding 6. A lower surface 7 of the boot front end 3 rests on and is supported by a support device 8.

The support device 8 includes a stationary support 9 which is mounted to the ski and a movable support element 10 which is movably received in the stationary element 9. The movable support element 10 protrudes from an upper surface of the stationary support to provide an upper or bearing surface 100 on which the boot rests. The bearing surface 100 projects above an upper surface 90 of the stationary support sufficiently that the front end of the boot clears the stationary support.

The stationary support 9 has a width L9 which is approximately equal but slightly less than a width L2 of the ski 2.

With continuing reference to FIGS. 1 and 2 and further reference to FIGS. 3–10, the stationary support 9 includes a base to which an upper element or cover 12 is attached. The base and upper element are made, preferably, of a tough, highly abrasion-resistant plastic material such as an acetal type resin, polypropylene, or polyamide. The base is attached, for example, to the ski by gluing, screws or other mechanical fasteners, by connection to the front binding assembly 4, such as with a base plate 40, or the like.

The movable support element 10 is preferably made of metal, or other materials such as acetyl resin. The movable element 10 extends the entire width of the stationary support element, in the preferred embodiment. The movable element is movably received in relation to the stationary support element for movement at least transversely to the right DR (FIG. 3*a*) and to the left GA (FIG. 3*b*) relative to a longitudinal axis or plane XX' of symmetry of the ski. More specifically, displacement of the mobile element 10 occurs along a circular trajectory T with a radius R centered at a point O located on the plane of symmetry XX' under the heel of the boot. The radius R may, for example, be about 230 mm, but will typically range between 150 and 300 mm, depending on the size of the boot.

The movable support element 10 has a profile which is curved with a similar radius such that it glides in a correspondingly shaped groove 13 in the stationary support 9. In the rest position, the movable element is centered and maintained centered by a biasing device which permits sliding in the groove to the right DR and to the left GA against the biasing force of a compression spring 14 or other resilient or compressible biasing device.

The groove 13 extends over the entire width of the stationary support and has a cross-section in the general shape of an inverted T. The groove includes an open central portion 130 from which a front groove 131*a* and a rear groove 131*r* extend forming a front projection 132*a* and a rear projection 132*r* which engage a top surface of the mobile support element 10, note, in particular, FIG. 7.

Figure 10:
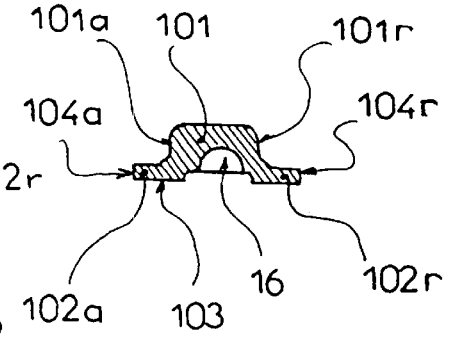
FIG. 10 is a sectional view through Section D—D of FIG. 9.
Figure 11:
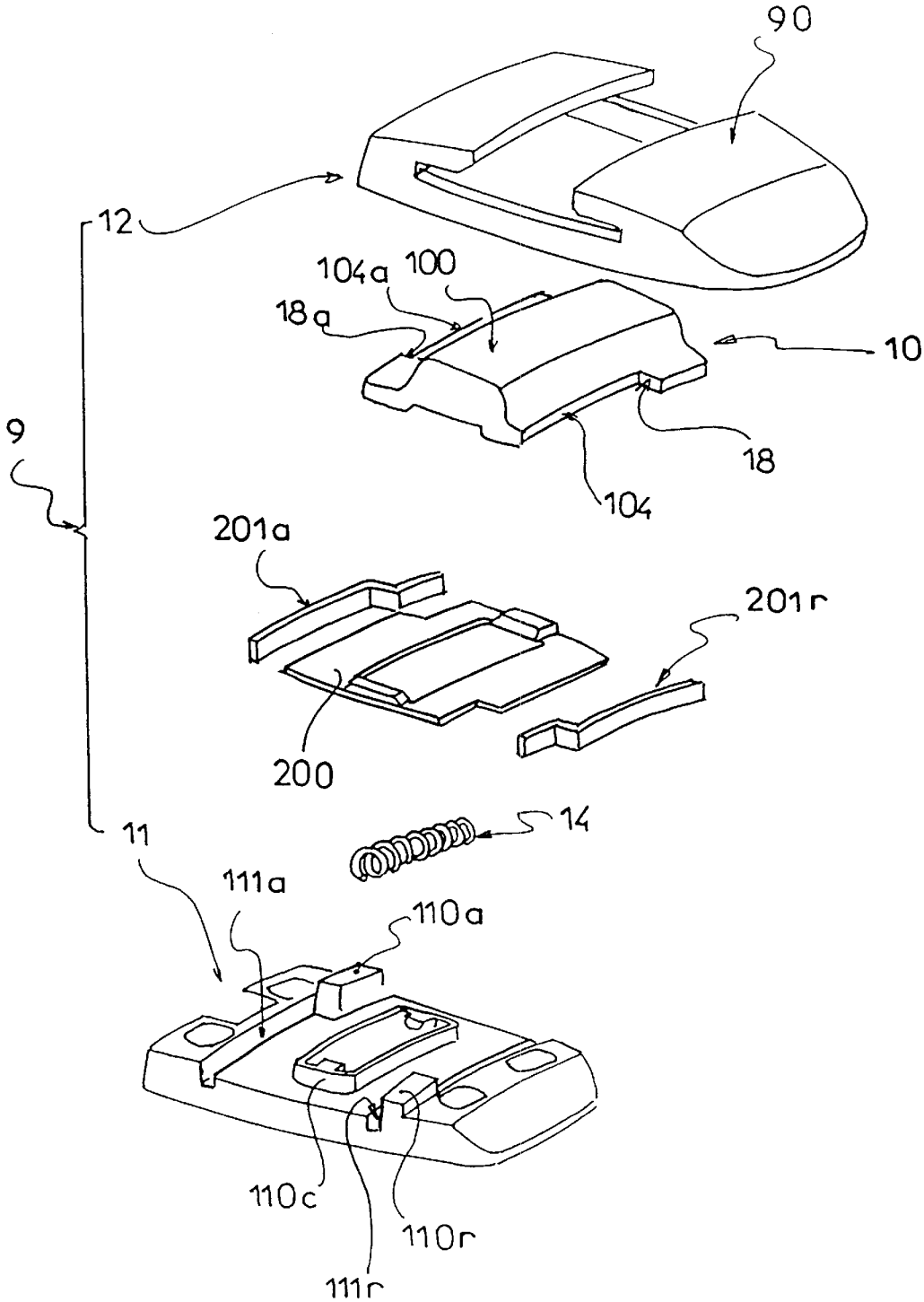
FIG. 11 is an expanded view of an alternate embodiment in accordance with the present invention.

The movable support element 10 has a transverse profile whose cross-section corresponds to the cross-section of the groove 13. The movable support element 10 extends, preferably, over the entire width of the stationary support and is also in the shape of an inverted T. The movable support element includes a transverse body 101 whose lower portion extends to the front to form a front rim 102*a* and to the rear to form a rear rim 102*r* (FIG. 10). The lower front and rear rims 102*a*, 102*r* are received in the front and rear grooves 131*a*, 131*r*, respectively.

The spring 14 biases the movable support element 10 to a centered position. Lateral displacements of the movable support element compress the spring which then urges the movable element to return to the centered position. The spring is lodged with its lower half in a lower spring housing 15 in the stationary support, more specifically in an upper surface 133 of the groove 13. The upper surface 133 of the groove 13 is defined in the base 11 in the preferred embodiment. Further, the spring 14 is lodged in an upper spring receiving housing or pocket 16 defined in a lower surface 103 of the movable support element 10. The upper spring chambers or housing 16 has the same length as the lower spring chamber or housing 15 and is preferably slightly shorter than the length of the uncompressed spring 14. In this manner, the spring is inserted into the upper and lower spring housings under slight compression in order to be prestressed when the movable support element is in its centered position. Under lateral displacement of the movable support element 10, the movable support element compresses the spring either to one side or to the other side of the lower spring housing in order to bias the movable element back toward its centered position.

A series of stops limit side-to-side displacement of the movable support element 10. More specifically, the base 11 defines a right stop 17*a* which limits displacement of the movable support element to the right, and a left stop 17*r* which limits displacement toward the left. The two base stops 17*a*, 17*r* cooperate with corresponding stops 18*a*, 18*r* defined on the movable support element 10. In the preferred embodiment, the stops 18*a*, 18*r* are defined cut-outs or clearances 19*a*, 19*r* in the flanges 102*a*, 102*r*.

At least one anti-friction sliding element 20 which has a low coefficient of friction is disposed between the movable support element 10 and the stationary support 9 to promote and control the lateral displacement of the movable support element relative to the stationary support. The sliding element is made of a low coefficient of friction material such as polytetrafluoroethylene (TEFE), high-density polyethylene, polytetrafluoroethylene loaded with bronze balls, or other appropriate low friction materials. The anti-friction sliding element is constructed of a material which. has a lower coefficient of friction than does the material of which the base support 9, particularly the portions of the base support which define the sliding groove 13. The anti-friction element 20 is preferably made of a material having a lower coefficient of friction than the material from which the movable support element 10 is made.

The anti-friction element 20 includes at least one small lower horizontal anti-friction plate 200 disposed between a lower surface 103 of the movable support element and an upper surface 133 of the lateral groove 13. Further, the anti-friction device includes a small anti-friction plate 201*a* and a small rear anti-friction plate 201*r*. The small front anti-friction plate 201*a* is arranged between the rear surface 133*a* of the front groove 131*a* and the front surface 104*a* of the front edge 102*a* of the movable support element 10. The small rear anti-friction plate 201*r* is disposed between the front surface 133*r* of the rear groove 131*r* and the rear surface 104*r* of the movable support element 10. The small front anti-friction plate 201*a* is disposed between the movable support element 10 and the stationary support element 9 toward the front AV in such a manner that under forward force, it engages a forward edge of the movable support element to define a forward bearing or friction surface therebetween. Analogously, the rear anti-friction plate 201*r* is disposed between a rear edge of the movable support element and a rear edge 133*r* toward the rear and serves as a bearing or stop surface between the movable and stationary support elements under a rearward force.

The front anti-friction plate 201*a* and the rear anti-friction plate 201*r* are, preferably, extensions of the lower anti-friction plate 200 and are integrally formed therewith. The anti-friction plate assembly is fixedly mounted in the groove 13 and is bonded to the stationary support by welding, gluing, encasing, or the like. In the illustrated embodiment, the anti-friction element is retained in the groove by two lateral projections 110*a*, 110*r* in a central projection 110*c*.

Of course, the front and rear anti-friction plates can be constructed as separate elements from the lower anti-friction plate 200 as illustrated in FIG. 11 and FIGS. 11*a*–11*c*. In the illustrated embodiment, the front plate 201*a* and the rear plate 201*r* are engaged in a corresponding transverse groove 111*a*, 111*r* defined in the base 11.

Figure 12:
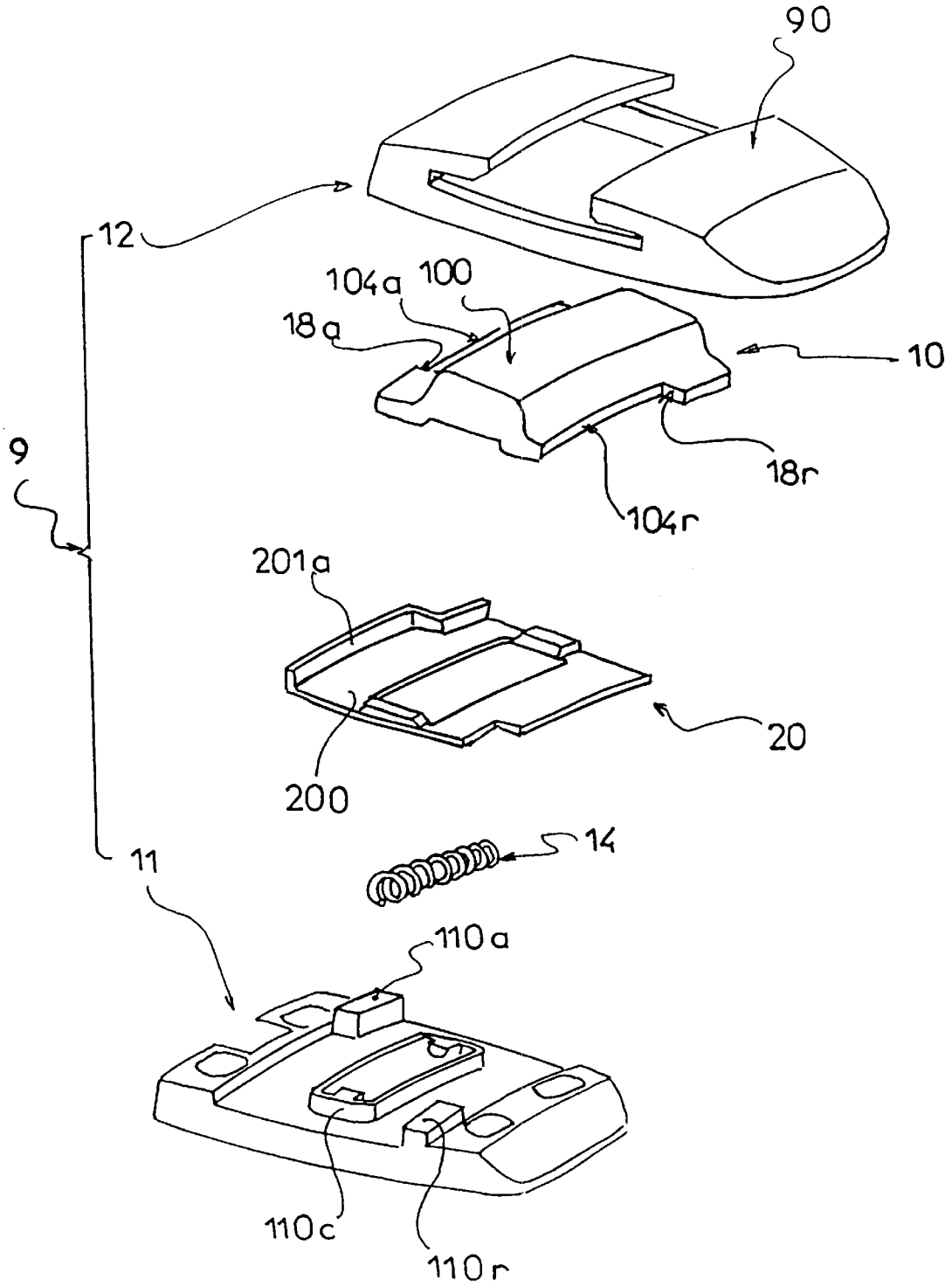
FIG. 12 is an exploded view of another alternate embodiment in accordance with the present invention.
Figure 13:
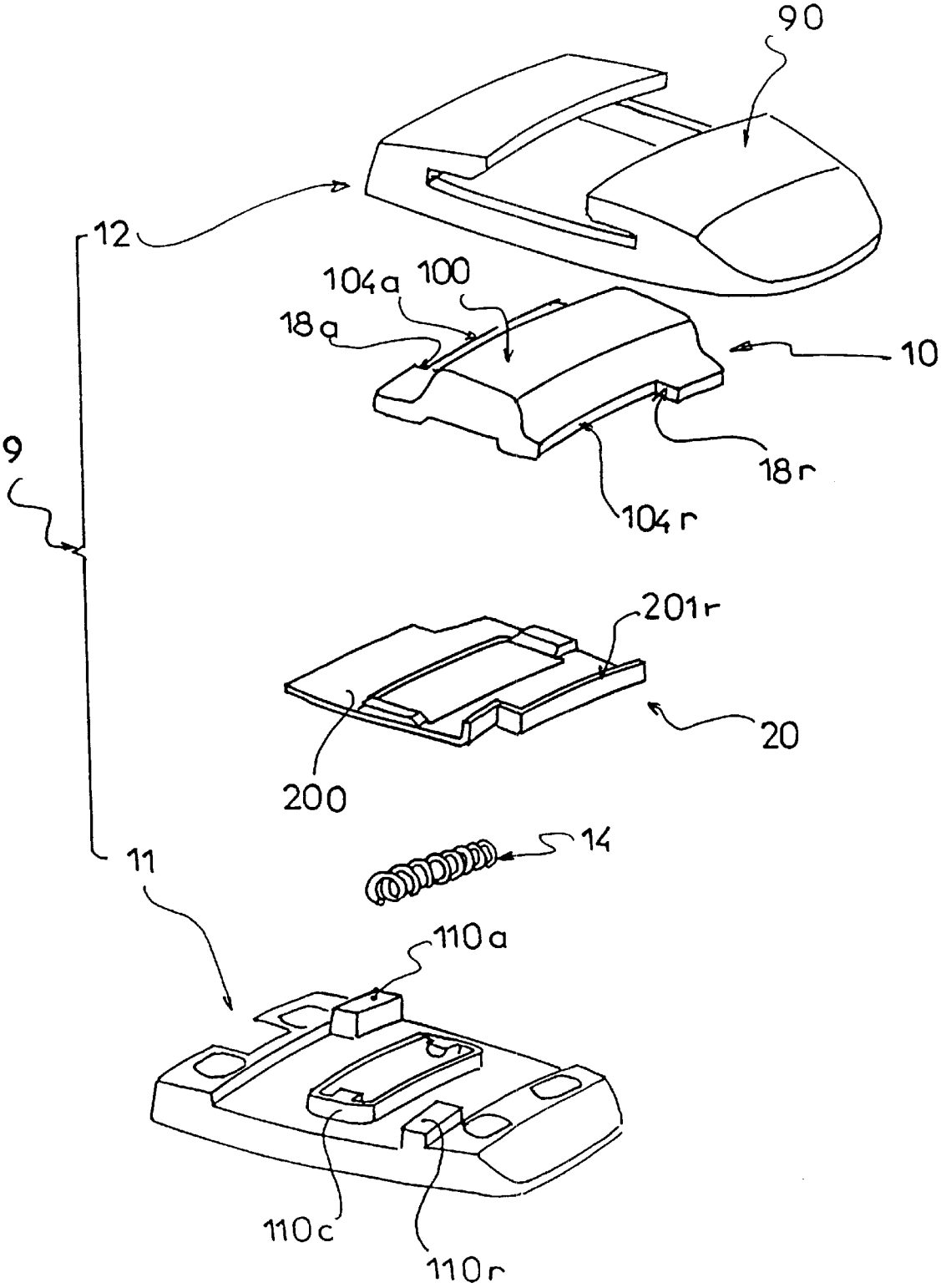
FIG. 13 is an exploded view of another alternate embodiment in accordance with the present invention.

With reference to FIGS. 12 and 12*a*, it is also contemplated that the lower anti-friction plate 200 is accompanied by only a front plate 201*a*. Alternately, as illustrated in FIGS. 13 and 13*a*, it is also contemplated that the lower anti-friction plate 200 is accompanied by only the rear plate 201*r*.

Figure 14:
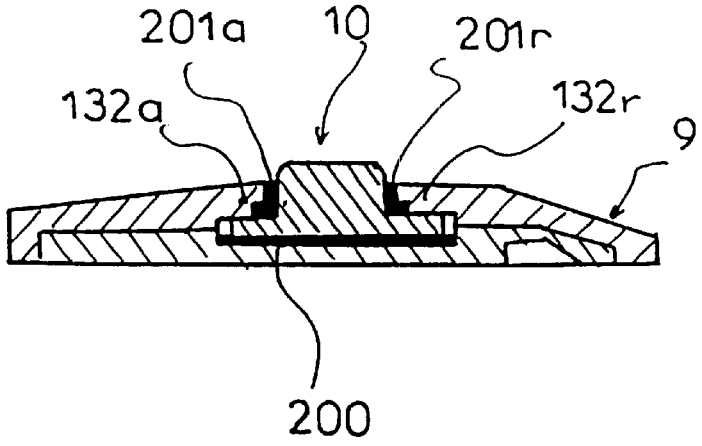
FIG. 14 is a sectional view of yet another alternate embodiment in accordance with the present invention.

With reference to FIG. 14, it is to be appreciated that the front anti-friction plate 201*a* and the rear anti-friction plate 201*r* can also be positioned between the front projection 132*a* and the rear projection 132*r* and the front lateral surface 101*a* and the rear lateral surface 101*r* (FIG. 10) of the transverse body 101. The anti-friction element is approximately equal to the width of the sliding groove and the width of the mobile support element. Thus, the anti-friction element is totally secured in the sliding groove and is protected against dirt and scratches.

In the embodiments in which the front and rear anti-friction elements are located beneath the vertical holding projections 132*a*, 132*r*, additional protection is provided.

Figure 15A:
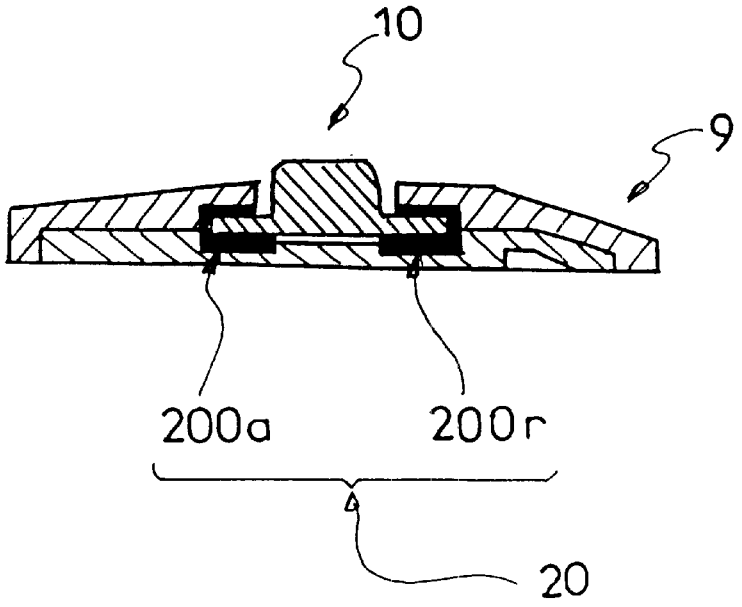
FIG. 15*a* is a longitudinal cross-sectional view of the assembled device of FIG. 15.
Figure 15:
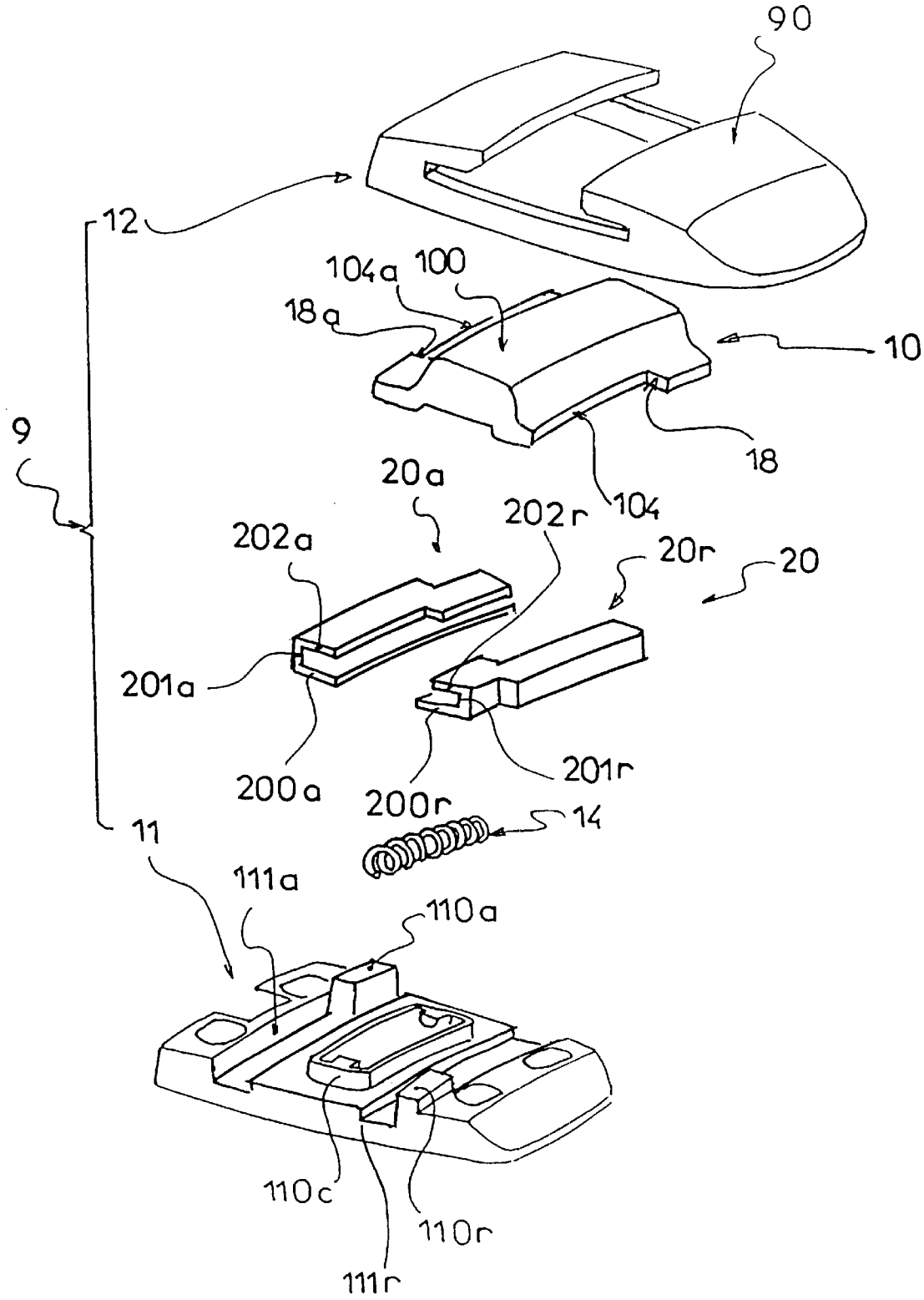
FIG. 15 is an exploded view of yet another alternate embodiment in accordance with the present invention in which the anti-friction element also assures upward restriction relative to the movable support element.

With reference to FIGS. 15 and 15*a*, the anti-friction element restrains the movable support element 10 against movement in an upward direction. A front anti-friction element 20*a*, and a rear anti-friction element 20*r* each have a transverse U-shaped profile. The U-shaped profile of the anti-friction elements define a bottom support surface 200*a*, 200*r*, a front support surface 200*a*, and a rear support surface 200*r*, as well as an upper front support surface 202*a*, and an upper rear support surface 202*r*.

Figure 16:
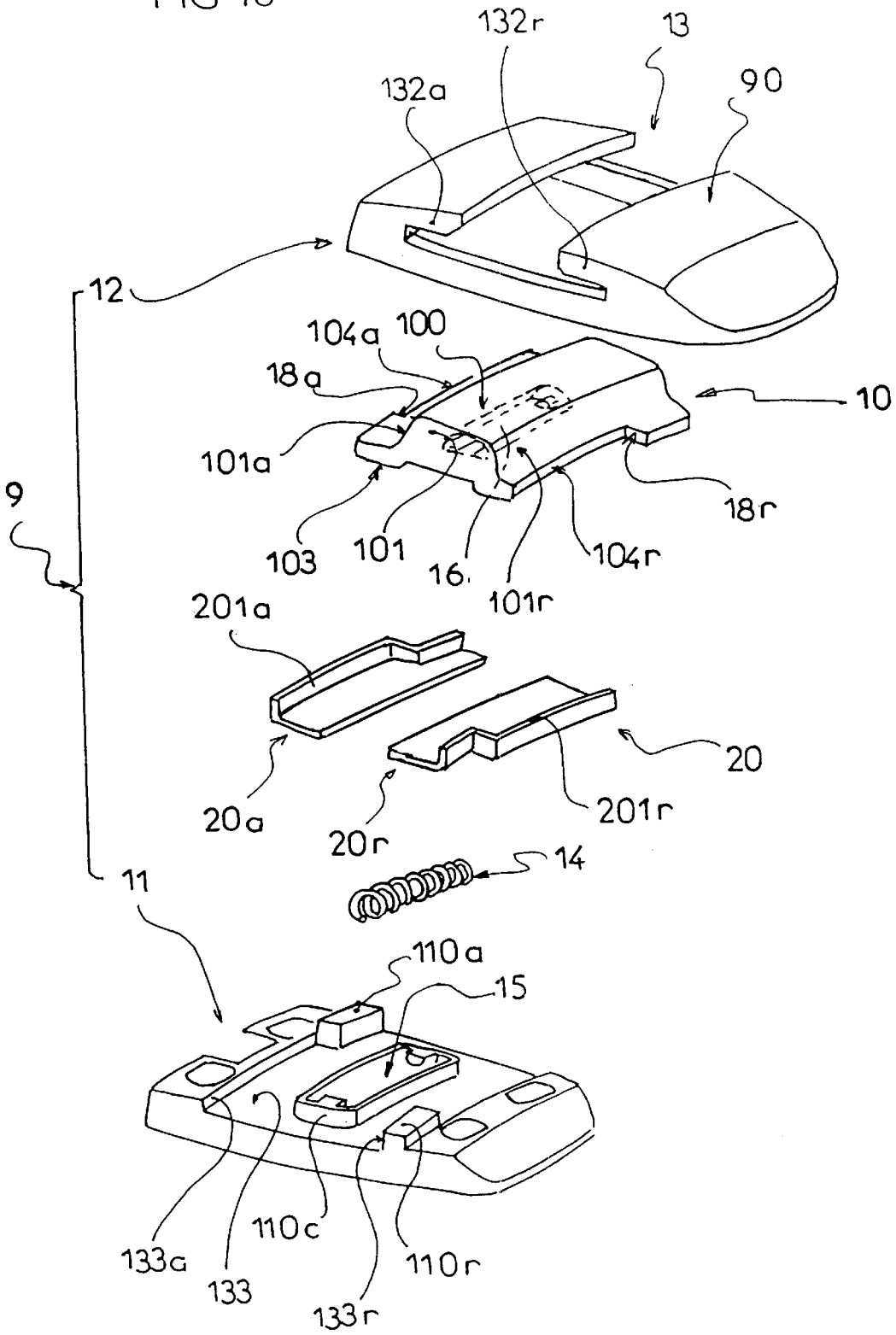
FIG. 16 is an exploded view of yet another alternate embodiment in accordance with the present invention; and, FIG. 17 is an exploded of yet another alternate embodiment.

With reference to FIG. 16, the anti-friction element 20 includes a front anti-friction support element 20*a* and a rear anti-friction support element 20*r*. The two anti-friction support elements are independent and not joined to each other.

Figure 17:
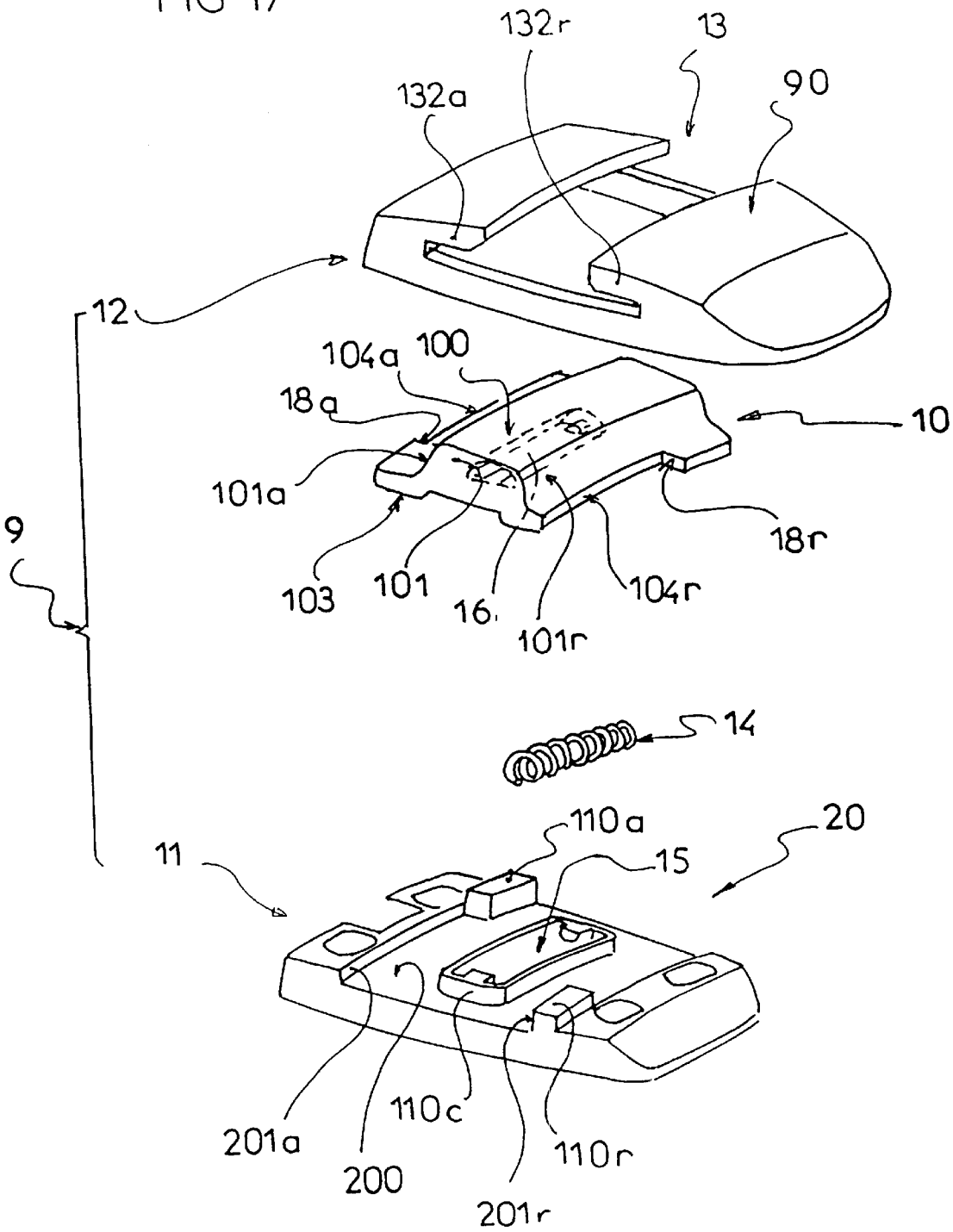

With reference to FIG. 17, the base 11 is itself fabricated from the anti-friction material with the low coefficient of friction.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A support device for supporting a ski boot on a ski, the device comprising:

a movable support element for supporting the ski boot;

a stationary support element on which the movable support element is movably supported;

an anti-friction element configured of a material having a lower coefficient of friction than the material of which at least one of the stationary support and the movable support element are fabricated and disposed between the movable support element and the stationary support element along a bottom and at least one of a front and back of the movable support element.

2. The support device according to claim 1 further including:

at least one upper anti-friction element which engages an upper surface of the movable support element to restrain upward movement thereof.

3. The support device according to claim 1 wherein the anti-friction element is constructed of one of polytetrafluoroethylene and high-density polyethylene.

4. The support device according to claim 3 wherein at least one of the stationary support and the movable support element are fabricated of acetal resin.

5. The support device according to claim 1 wherein at least one of the stationary support and the movable support element are fabricated of acetal resin.

6. The support device according to claim 1 wherein the anti-friction element includes:

a lower, horizontal anti-friction plate; and a vertically extending front anti-friction plate.

7. The support device according to claim 6 wherein the anti-friction element further includes:

a rear, vertically extending anti-friction plate.

8. The support device according to claim 7 wherein at least one of the front anti-friction plate and the rear anti-friction plate are integrally formed with the lower anti-friction plate.

9. The support device according to claim 1 wherein the stationary support defines a transverse curved sliding groove, the movable support element being slidably received in the groove.

10. The support device according to claim 9 wherein the movable support element and the groove have a common radius of curvature.

11. The support device according to claim 10 wherein the radius of curvature is between 150 and 360 mm.

12. A support device for supporting a ski boot on a ski, the device comprising:

a movable support element for supporting the ski boot;

a stationary support element having upper, front, and rear surfaces on which bottom, front, and rear surfaces of the movable support element are movably supported;

a lower anti-friction plate having a lower coefficient of friction than at least one of the movable support element and the stationary support element and mounted between the movable support element bottom surface and the stationary support upper surface;

a front anti-friction plate having a lower coefficient of friction than at least one of the movable support element and the stationary support element and mounted between the movable support element front surface and the stationary support element front surface;

a rear anti-friction plate having a lower coefficient of friction than at least one of the movable support element and the stationary support element and mounted between the movable support element rear surface and the stationary support element rear surface;

at least one of the front and rear anti-friction plates being a separate independent elements from the lower anti-friction plate.

13. A support device for supporting a ski boot on a ski, the device comprising:

a movable support element for supporting the ski boot;

a stationary support element in which a groove is defined, the movable support element being slidably received in the groove;

an anti-friction element constructed of a material with a lower coefficient of friction than at least one of the movable support element and the stationary support element and mounted in the groove between the movable support element and the stationary support element, the anti-friction element including:

a horizontal anti-friction plate arranged between a lower surface of the movable support element and an upper surface of the groove defined in the stationary support element;

a front anti-friction plate arranged between a front surface of the groove and a front surface of the movable support element;

a rear anti-friction plate disposed between a rear surface of the groove and a rear surface of the movable support element.

14. A ski binding assembly for releasably attaching a ski boot to a ski, the ski binding assembly comprising:

a front binding which releasably engages a toe of the ski boot, the front binding being releasable under lateral force such that when the front binding releases, the toe of the ski boot can move laterally right or left relative to the ski;

a rear binding for releasably engaging a heel of the ski boot, the rear binding releasing the boot heel in response to upward force as the boot heel moves away from the ski;

a support device mounted to the ski adjacent the front binding for supporting a forward portion of a sole of the ski boot to reduce frictional interengagement between the front part of the ski boot and the ski which frictional engagement might inhibit lateral movement of the ski boot relative to the ski inhibiting release of the front binding, the support device including:

a base portion which is affixed to an upper surface of the ski, the base portion including a laterally elongated recessed bottom wall, a laterally extending front wall, and a rear wall parallel to the front wall which define a lateral groove extending laterally across the ski;

a movable element slidably received in the groove, the movable element having an upper surface which engages the forward portion of the sole of the ski boot and a lower portion which is received in the groove;

a friction reducing layer disposed between the movable element and at least the bottom and front walls of the groove to facilitate free movement of the movable element along the groove, the friction reducing layer having a lower coefficient of friction than the base portion.

15. The ski binding assembly as set forth in claim 14 wherein the groove and the movable element extend along a circular arc segment, which circular arc segment has a geometric center disposed below the heel of the ski boot.

16. The ski binding assembly as set forth in claim 14 wherein the movable element and the base portion have extending stop elements which engage with each other to limit lateral movement of the movable element to prevent the movable element from sliding out of the groove.

17. The ski binding assembly as set forth in claim 14 further including a spring member connected with the movable element and the base portion for biasing the movable element to a central location in the groove.

* * * * *